US007797974B2

(12) United States Patent
Krüger et al.

(10) Patent No.: US 7,797,974 B2
(45) Date of Patent: Sep. 21, 2010

(54) METHOD AND DEVICE FOR MEASURING AND ADJUSTING THE EVENNESS AND/OR TENSION OF A STAINLESS STEEL STRIP OR STAINLESS STEEL FILM DURING COLD ROLLING IN A 4-ROLL STAND, PARTICULARLY IN A 20-ROLL SENDZIMIR ROLL STAND

(75) Inventors: Matthias Krüger, Hilchenbach (DE); Olaf Norman Jepsen, Siegen (DE); Michael Breuer, Hilchenbach (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 644 days.

(21) Appl. No.: 11/629,505

(22) PCT Filed: Jun. 17, 2005

(86) PCT No.: PCT/EP2005/006570

§ 371 (c)(1),
(2), (4) Date: Dec. 13, 2006

(87) PCT Pub. No.: WO2006/002784

PCT Pub. Date: Jan. 12, 2006

(65) Prior Publication Data

US 2008/0271508 A1 Nov. 6, 2008

(30) Foreign Application Priority Data

Jul. 6, 2004 (DE) ..... 10 2004 032 634

(51) Int. Cl.
*B21B 37/28* (2006.01)

(52) U.S. Cl. ..... 72/9.1; 72/7.6; 72/8.7; 72/242.4

(58) Field of Classification Search ..... 72/7.1, 72/7.6, 8.9, 9.1, 9.2, 11.6, 11.7, 11.8, 205, 72/242.4, 365.2, 366.2, 8.6, 8.7, 11.4, 12.3; 73/862.07; 700/148, 154
See application file for complete search history.

(56) References Cited

U.S. PATENT DOCUMENTS 4,981,028 A * 1/1991 Berger et al. ..... 72/8.7

(Continued)

FOREIGN PATENT DOCUMENTS

EP 0 349 885 1/1995
EP 0 647 164 9/1997

OTHER PUBLICATIONS

Patent Abstracts of Japan, vol. 012, No. 067 (M-673), Mar. 2, 1988 & JP 62 214814 A (Kobe Steel Ltd) , Sep. 21, 1987.

(Continued)

*Primary Examiner*—Edward Tolan
(74) *Attorney, Agent, or Firm*—Lucas & Mercanti, LLP; Klaus P. Stoffel

(57) ABSTRACT

A method and device for measuring and adjusting the evenness and/or tension of a stainless steel strip (1) during cold rolling in a 4-roll stand (2) provided with at least one control loop (4) comprising several actuators (3), resulting in more precise measurement and adjustment due to the fact that an evenness defect (10) is determined by comparing a tension vector (8) with a predefined reference curve (9), whereupon the characteristic of the evenness defect (10) along the width of the strip is broken down into proportional tension vectors (8) in an analysis building block (11) in a mathematically approximated manner and the evenness defect proportions (C1 . . . Cx) determined by real numerical values are supplied to respectively associated control modules (12*a;* 12*b*) for actuation of the respective actuator (3).

21 Claims, 9 Drawing Sheets

U.S. PATENT DOCUMENTS

| | | | | | |
|---|---|---|---|---|---|
| 5,255,548 | A | * | 10/1993 | Melzer | 72/8.5 |
| 5,535,129 | A | * | 7/1996 | Keijser | 700/148 |
| 5,680,784 | A | * | 10/1997 | Tateno et al. | 72/8.7 |
| 5,692,407 | A | * | 12/1997 | Kajiwara et al. | 72/241.4 |
| 5,758,533 | A | * | 6/1998 | Quehen et al. | 72/163 |
| 6,868,707 | B2 | * | 3/2005 | Nishi et al. | 72/11.9 |

OTHER PUBLICATIONS

Patent Abstracts of Japan, vol. 016, No. 359 (M-1289), Aug. 4, 1992 & JP 04 111 910 A (Kobe Steel Ltd), Apr. 13, 1992.

Suzuki et al., "Strip Shape Control System . . . ", Conference Record of the 1999 IEEE, Phoenix, AZ, Oct. 1999, vol. 1, Oct. 3, 1999, XP010355191.

* cited by examiner

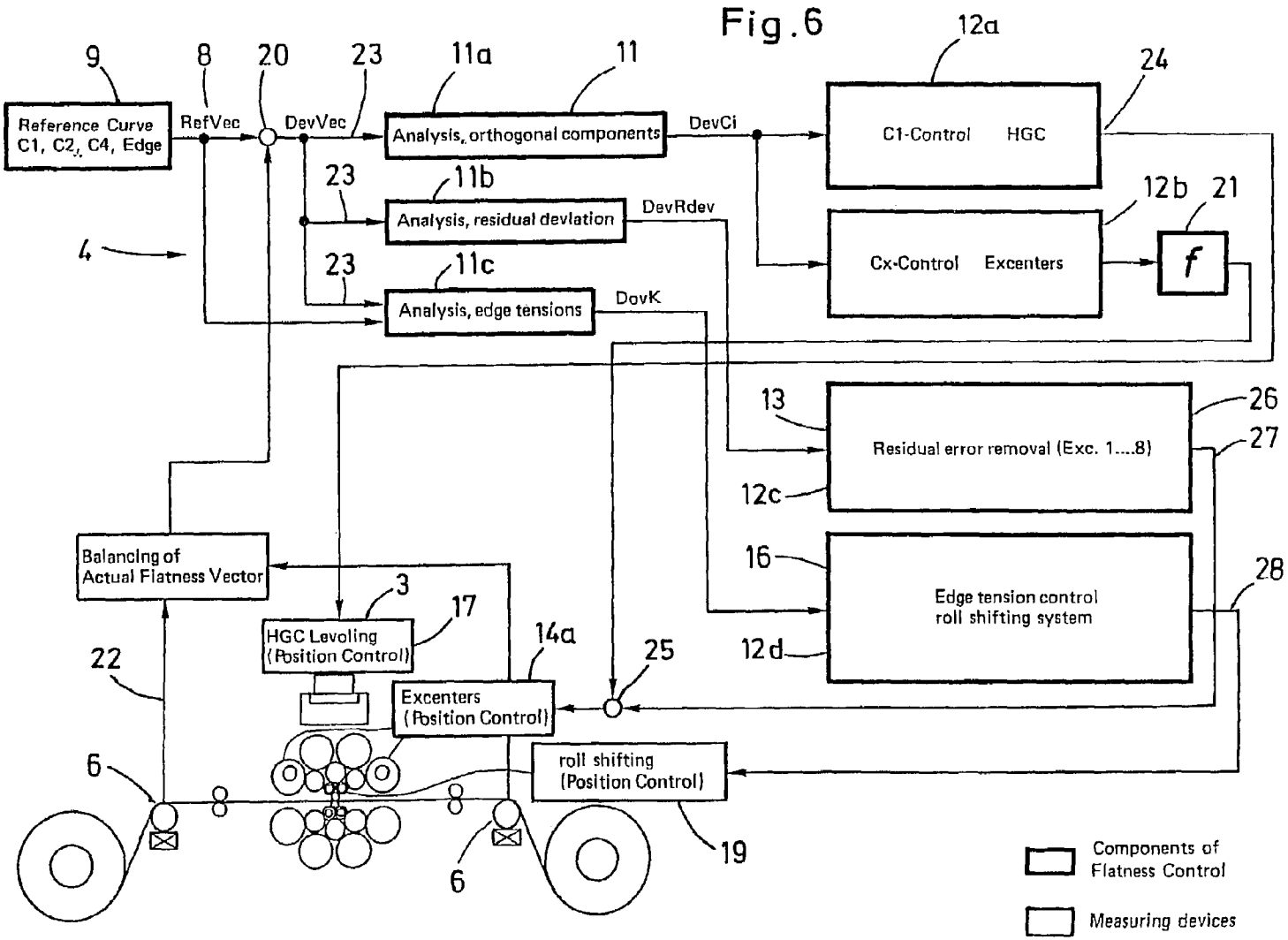
Fig.6
Reference Curve C1, C2, C4, Edge
RefVec
DevVec
Analysis, orthogonal components
Analysis, residual deviation
Analysis, edge tensions
DevCi
DevRdev
DovK
C1-Control HGC
Cx-Control Excenters
f
Residual error removal (Exc. 1...8)
Edge tension control roll shifting system
Balancing of Actual Flatness Vector
HGC Levoling (Position Control)
Excenters (Position Control)
roll shifting (Position Control)
Components of Flatness Control
Measuring devices
4
6
8
9
11
11a
11b
11c
12a
12b
12c
12d
13
14a
16
17
19
20
21
22
23
24
25
26
27
28
3

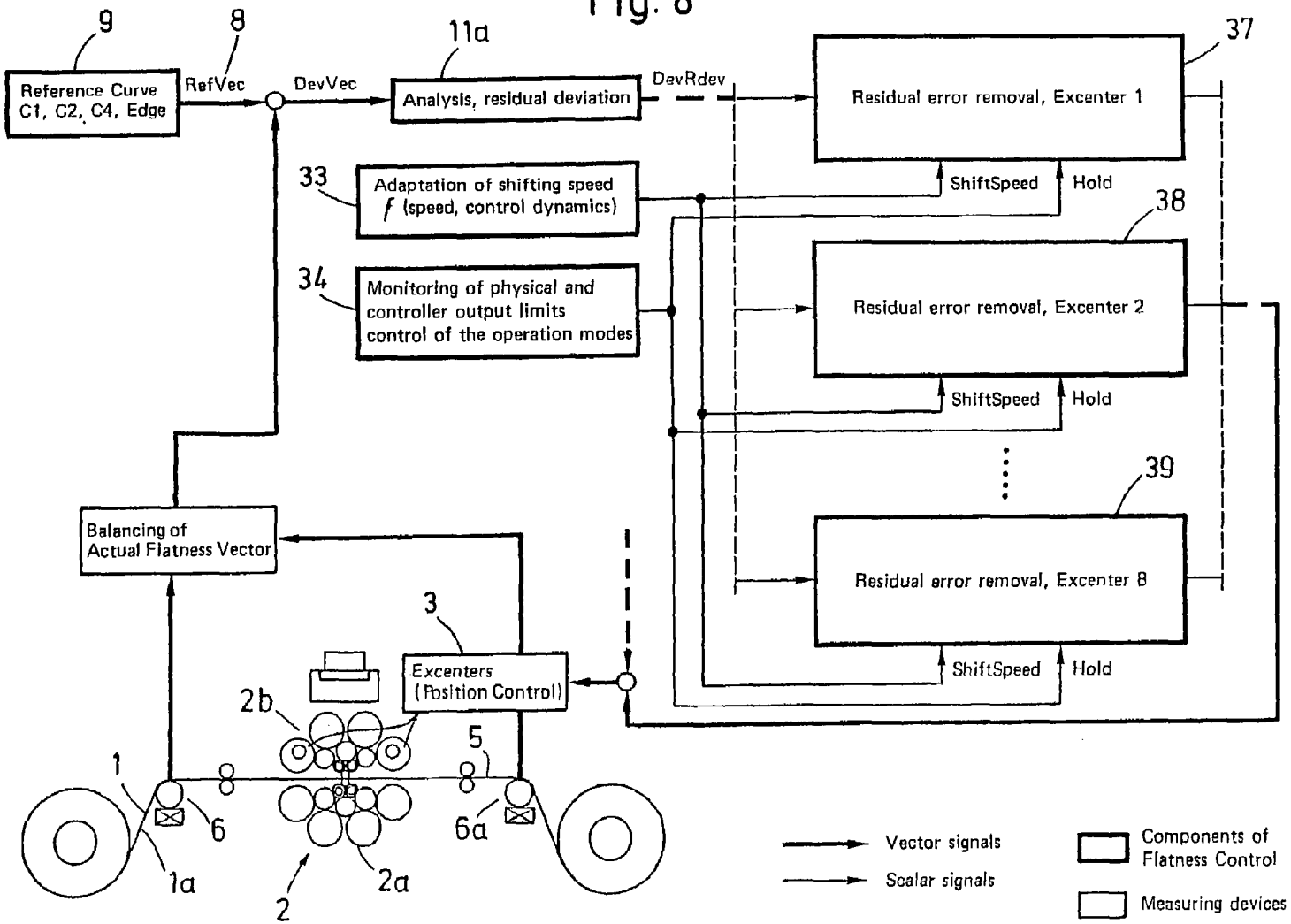
Fig. 8
Reference Curve C1, C2, C4, Edge
9
RefVec
8
DevVec
Analysis, residual deviation
11a
DevRdev
Adaptation of shifting speed f (speed, control dynamics)
33
Monitoring of physical and controller output limits control of the operation modes
34
Residual error removal, Excenter 1
37
Residual error removal, Excenter 2
38
Residual error removal, Excenter 8
39
Hold
ShiftSpeed
Balancing of Actual Flatness Vector
Excenters (Position Control)
3
1
1a
6
2b
2
2a
5
6a
Components of Flatness Control
Measuring devices
Vector signals
Scalar signals

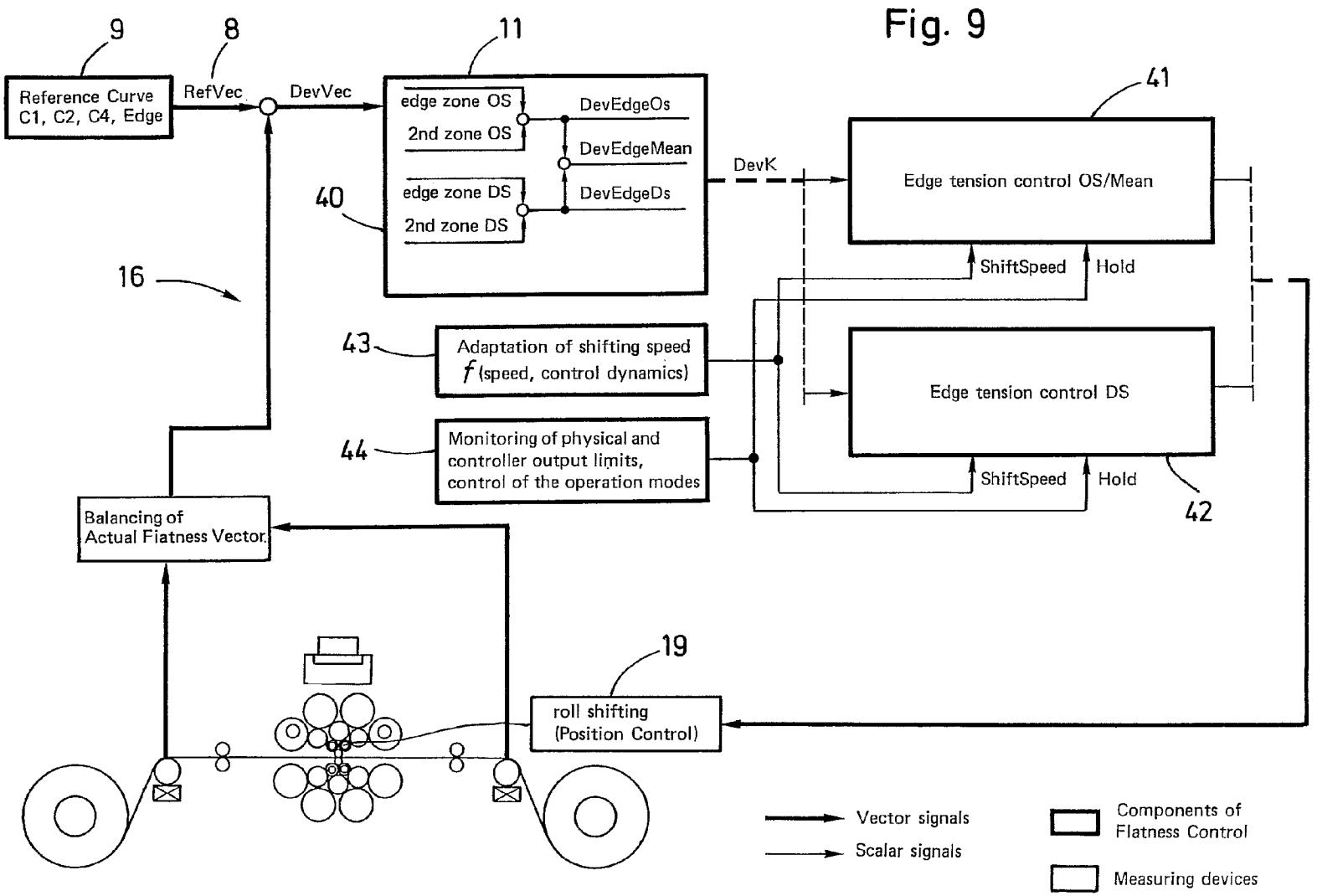
Fig. 9
Edge tension control OS/Mean
Edge tension control DS
Hold
ShiftSpeed
Hold
ShiftSpeed
41
42
DevK
DevEdgeOs
DevEdgeMean
DevEdgeDs
edge zone OS
2nd zone OS
edge zone DS
2nd zone DS
11
40
Adaptation of shifting speed
f (speed, control dynamics)
43
Monitoring of physical and
controller output limits,
control of the operation modes
44
roll shifting
(Position Control)
19
DevVec
RefVec
8
Reference Curve
C1, C2, C4, Edge
9
16
Balancing of
Actual Flatness Vector
Components of
Flatness Control
Measuring devices
Vector signals
Scalar signals

METHOD AND DEVICE FOR MEASURING AND ADJUSTING THE EVENNESS AND/OR TENSION OF A STAINLESS STEEL STRIP OR STAINLESS STEEL FILM DURING COLD ROLLING IN A 4-ROLL STAND, PARTICULARLY IN A 20-ROLL SENDZIMIR ROLL STAND

The invention concerns a method and a device for measuring and adjusting the flatness and/or the strip tension of a high-grade steel strip or a high-grade steel foil during cold rolling in a cluster mill, especially in a 20-roll Sendzimir rolling mill, with at least one closed-loop control system comprising several actuators, wherein the actual strip flatness in the runout of the cluster mill is measured by a flatness measuring element on the basis of the strip tension distribution over the width of the strip.

Cluster mills of this type have a split-block or monoblock design, wherein the upper and lower sets of rolls can be adjusted independently of each other, and this can result in different housing frames.

The method mentioned at the beginning is known from EP 0 349 885 B1 and comprises the formation of measured values which characterize the flatness, especially the tensile stress distribution, on the runout side of the rolling stand, and, depending on these measured values, actuators of the rolling mill are actuated, which belong to at least one closed-loop control system for the flatness of the rolled sheets and strips. In order then to reduce the different time response of the actuators of the rolling mill, the previously known method proposes that the speeds of the different actuators be adapted to one another and that their regulating distances be evened out. However, this fails to catch other sources of errors.

Another previously known method (EP 0 647 164 B1), which is a method for obtaining input signals in the form of roll gap signals, for control elements and controllers for actuators of the work rolls, measures the tension distribution transversely with respect to the strip material, wherein the flatness errors are derived from a mathematical function in which the squares of the deviations are to assume a minimum, which is determined by a matrix, with the number of measuring points, the number of rows, the number of base functions, and the number of roll gaps in the measuring points. This procedure also fails to consider the flatness errors that occur under practical conditions and their development.

The objective of the invention is to achieve altered adjustment behavior of the individual actuators on the basis of more accurately measured and analyzed flatness errors in order to achieve greater flatness of the final product, so that the rolling speed can also be increased.

In accordance with the invention, this objective is achieved by determining a flatness error by comparison of a tension vector with a predetermined reference curve, then decomposing the curve of the flatness error over the width of the strip into proportional tension vectors in an analytical module in a mathematical approximation, and supplying the flatness error components determined by real numerical values to corresponding control modules to actuate the corresponding actuators. The advantage of this method is that it ensures a stable rolling process with a minimum rate of strip breakage and thus an increase in the potential rolling speed. Furthermore, the work of the operating personnel is simplified by the automatic adjustment of the flatness actuators to altered conditions, even in the case of incorrect settings. In addition, more uniform product quality is achieved, independently of the qualifications of the personnel. Moreover, the computation of the influencing functions and a computation of the control functions can be carried out in advance, resulting in savings of time. The flatness control system as a whole becomes more stable with respect to inaccuracies in the computed control functions. The inaccuracies remain without influence on start-up. The most important components of the flatness error are eliminated with maximum possible control dynamics. The orthogonal components of the tension vectors are linearly independent of one another, which rules out mutual effects of the components among one another. The scalar flatness error components are supplied to the individual control modules.

In accordance with a refinement of the invention, the curve of the flatness error over the strip width is approximated by an eighth-order Gaussian approximation (LSQ method) and then decomposed into the orthogonal components.

An improvement of the invention is obtained if a residual error vector is analyzed, and the residual error vector is sent to directly selected actuators. All flatness errors remaining after the highly dynamic correction process, which flatness errors can be influenced with the given influencing functions, are eliminated by the residual error removal as part of the available control range. Therefore, in addition to the aforementioned orthogonal components of the flatness error, it is advantageous also to consider a residual error, which is not supplied to the orthogonal components described above but rather directly to the actuators.

In accordance with additional steps, the residual error vectors can be assigned by weighting functions, which are derived from influencing functions of excenter actuators and assign the total flatness error that is present to the individual excenters.

In this regard, it is also advantageous if a magnitude of error determined by real numerical values is formed by summation from the residual error vectors assigned to the excenters.

In another refinement, the adjustment for the strip edges is carried out separately within the flatness adjustment. In this way, this type of adjustment can also possibly be completely shut off if it is not absolutely required.

In another improvement, the horizontal shift of the inner intermediate rolls is used as the actuator for the edge tension control system.

To this end, it is proposed as an improvement that a predetermined strip tension in the region of one to two outermost covered zones of a flatness measuring roller is adjusted separately for each edge of the strip by means of the edge tension control system.

In accordance with other features of the invention, the edge tension control system is operated optionally asynchronously or synchronously for the two strip edges.

In this regard, the controlled variable for the edge tension control system can be determined separately for each edge of the strip by taking the difference between the deviations of the two outermost measured values of the flatness measuring roller.

In accordance with the indicated state of the art, the device for measuring and adjusting the flatness and/or strip tension of a high-grade steel strip or a high-grade steel foil for a cold rolling operation in a cluster mill, especially in a 20-roll Sendzimir rolling mill, is based on at least one closed-loop control system for actuators, which consist of hydraulic adjustment mechanisms, excenters of the outer backup rolls, axially shiftable tapered inner intermediate rolls, and/or their influencing functions.

Therefore, with respect to a device, the previously stated objective is achieved by virtue of the fact that a comparison signal between a reference curve and the actual strip flatness of the flatness measuring element at the input of the closed-loop control system is put through to a first analyzer and independent, first and second control modules for the formation of the tension vectors and with the output to the actuator for the swiveling hydraulic adjustment mechanisms of the set of rolls, and that the comparison signal is simultaneously put through to a second analyzer and another, separate, second control module, whose computational result can be passed on to the actuator of the excenters via control functions with a coupling connection. In this way, the advantages associated with the method can be realized in a device.

In another improvement of the invention, the comparison signal between the reference curve and the actual strip flatness is put through by the independent analyzer to the independent, third control module for a flatness residual error, whose output is supplied to the coupling connection for the actuator consisting of the excenters.

In another design that continues the invention in this sense, the comparison signal between the reference curve and the actual strip flatness is put through by another, third independent analyzer to an independent, fourth control module for monitoring the edge tension control system, and its output is connected to the actuator of the tapered inner intermediate rolls.

Exact signal generation is assisted by the fact that a flatness measuring element installed in the runout is connected to the signal line of the actual strip flatness.

The remainder of the invention is designed in such a way that, for each flatness error vector, a dynamic individual controller is provided, which is provided as a PI controller with dead band in the input.

In another embodiment, in addition to the first analyzer, adaptive parameterizing means and a control display are arranged in parallel on the input side of each individual controller.

In addition, it is advantageous for connections for control parameters to be provided on each individual controller.

Furthermore, the dynamic individual controllers can be connected with a control console.

A further analogy to the method steps is that, to remove residual errors, the residual error vector cooperates via residual error controllers with the actuators of the excenters.

Independence of the measurements on the strip edges is achieved with respect to the device by virtue of the fact that the edge tension control system provides an analyzer for different strip edge zones of the flatness measuring roller, and that two strip edge controllers are connected to each analyzer.

In a refinement of this system, the strip edge controllers are connected with the actuators of the tapered intermediate rolls.

This makes it possible to switch the strip edge controllers independently of each other.

Finally, it is provided that an adaptive adjustment speed controller and a control display are connected to each set of two strip edge controllers.

The specific embodiments of the invention illustrated in the drawings are explained in greater detail below.

FIG. 6 shows an overview block diagram of the flatness control system for the 20-roll Sendzimir rolling mill.

FIG. 8 shows a block diagram on the structure of the residual error removal.

FIG. 9 shows a block diagram on the structure of the edge tension control.

Figure 1:
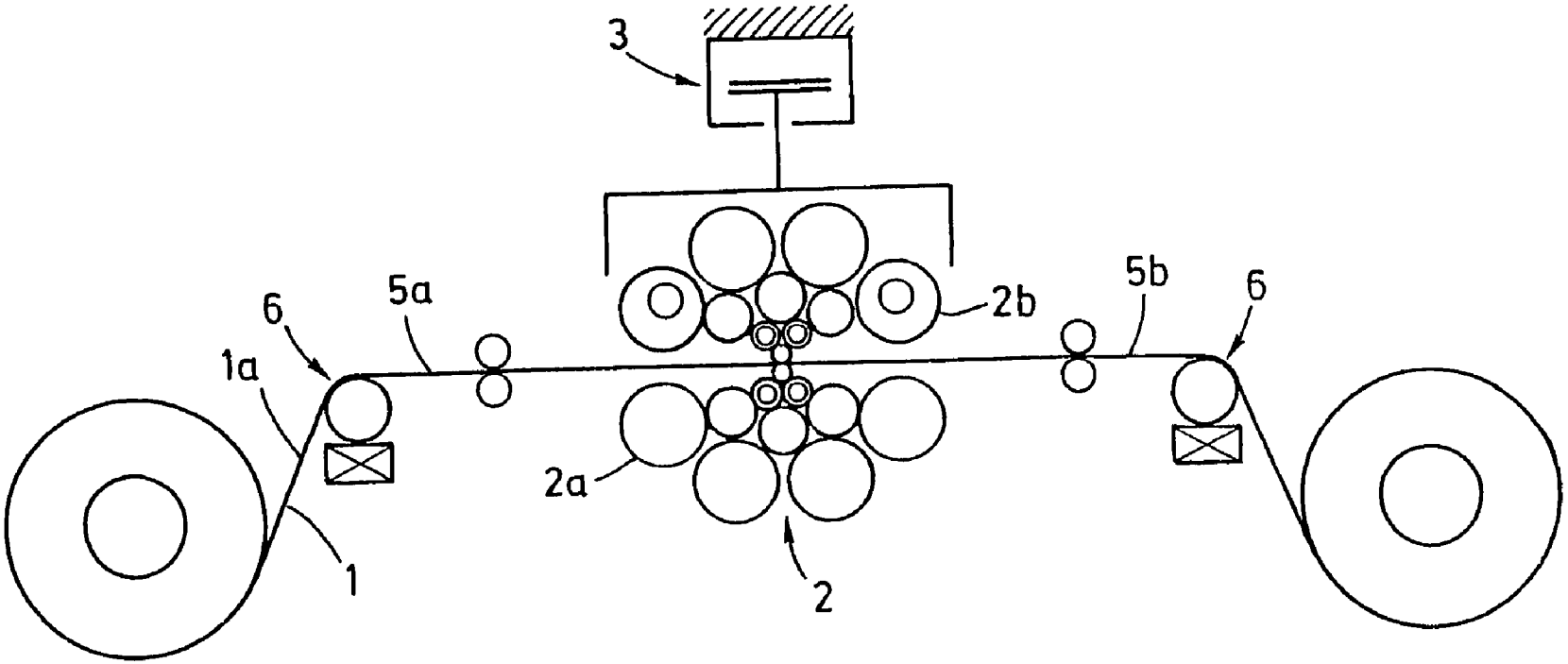
FIG. 1 shows a plant configuration of a 20-roll Sendzimir rolling mill.

According to FIG. 1, the high-grade steel strip 1 or a high-grade steel foil 1*a* is rolled in a cluster mill 2, a 20-roll Sendzimir rolling mill 2*a*, by uncoiling, rolling, and coiling. In this regard, the sets of rolls 2*b* represent a split-block design. The upper set of rolls 2*b* can be adjusted by an actuator 3 and other functions. Signals, which will be described later, are processed in a closed loop control system 4 (FIGS. 6 to 9). These signals are derived before the rolling operation from a run-in 5*a* and after the rolling from a runout 5*b* and are obtained by means of flatness measuring elements 6, which consist of flatness measuring rollers 6*a* in the illustrated embodiment.

Figure 2:
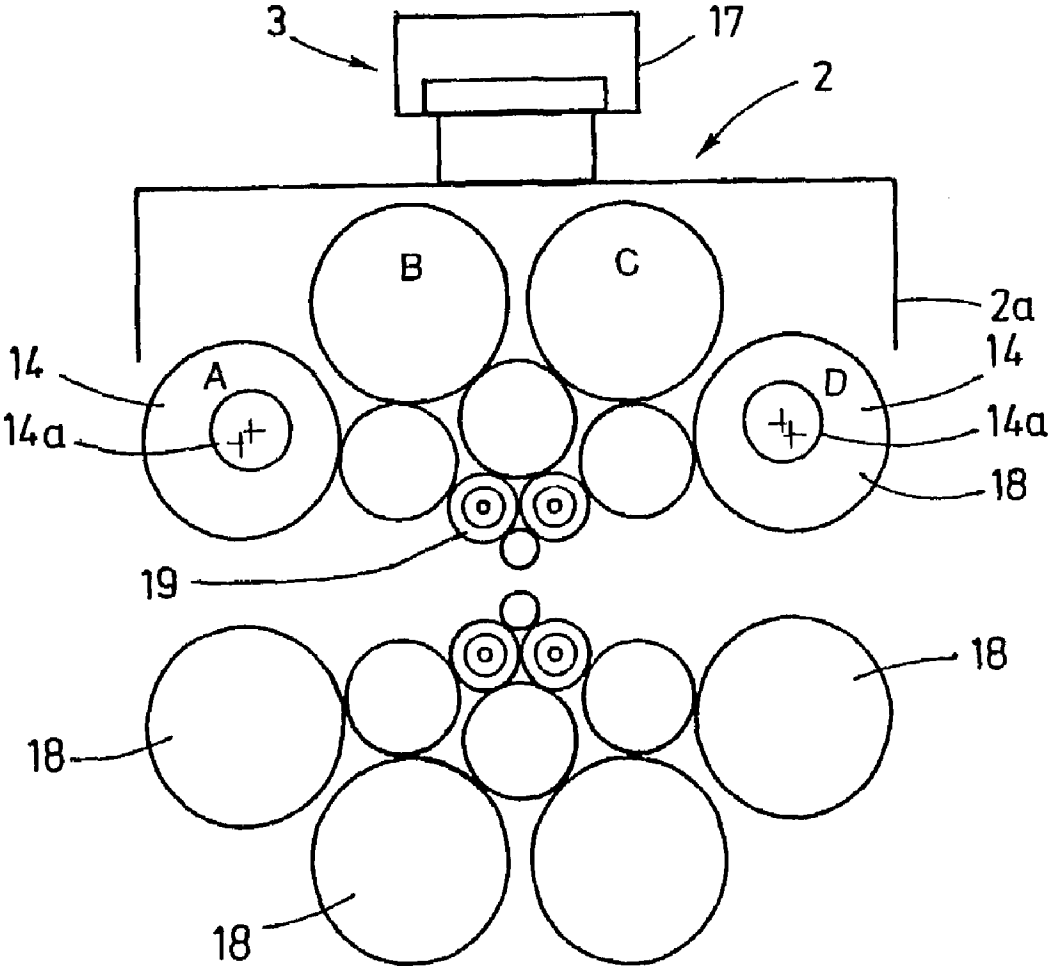
FIG. 2 shows an enlarged section of the roll sets in split-block design with the position determinations for the flatness actuators.

FIG. 2 shows a hydraulic adjustment mechanism 17 as the actuator 3 for the upper set of rolls 2*b*. Actuators 3 available for influencing the strip flatness are swiveling of the hydraulic adjustment mechanism 17 (used only in the case of the split-block design), an excenter actuator 14 of the outer backup rolls 18 (A, B, C, D, of which the backup rolls A and D, for example, are equipped with an excenter 14*a*), and an axial shift of tapered inner intermediate rolls 19.

The adjustment behavior of the excenter adjustment is characterized by the so-called "influencing functions". Two or more of the outer backup rolls 18 are provided with four to eight excenters 14*a* arranged over the width of the barrel, which can each be rotated by means of a hydraulic piston-cylinder unit, which makes it possible to influence the roll gap profile. The tapered inner intermediate rolls 19, which can be horizontally shifted by a hydraulic shifting device, have a conical cross section in the vicinity of the strip edges 15. The cross-sectional shaping is located on the tending side of the cluster mill 2 in the case of the two upper tapered intermediate rolls 19 and on the driving side in the case of the two lower tapered intermediate rolls 19 or vice versa. Accordingly, the tension on one of the two strip edges 15 can be influenced by synchronous shifting of the two upper and the two lower tapered intermediate rolls 19.

Figure 3:
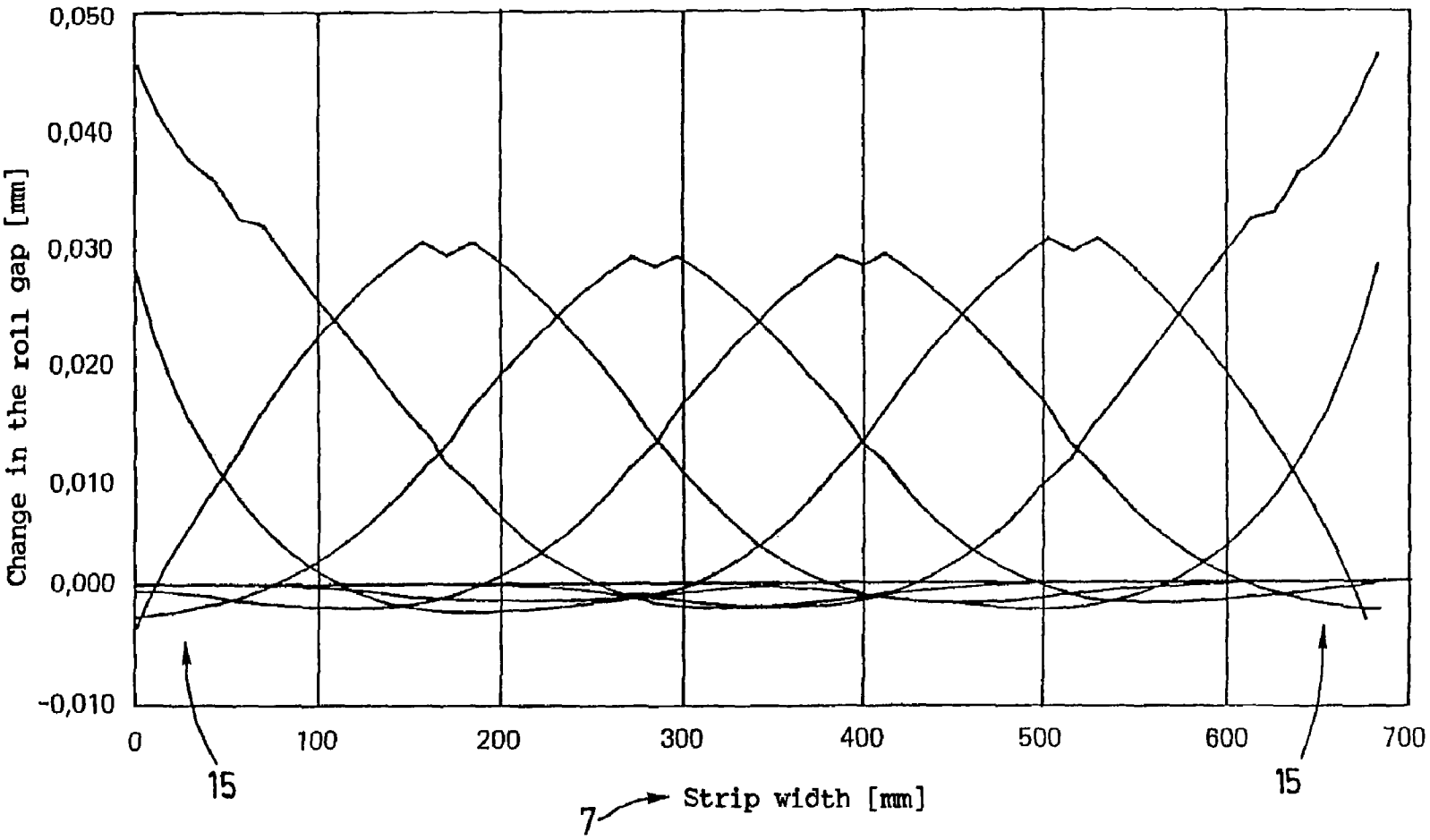
FIG. 3 shows a roll gap/strip width diagram with the influencing functions of the excenters on the roll gap profile.

For each of the eight adjustable excenters 14*a* of the illustrated embodiment, FIG. 3 shows the corresponding change of the roll gap profile between the strip edges 15 within the strip width 7.

Figure 4:
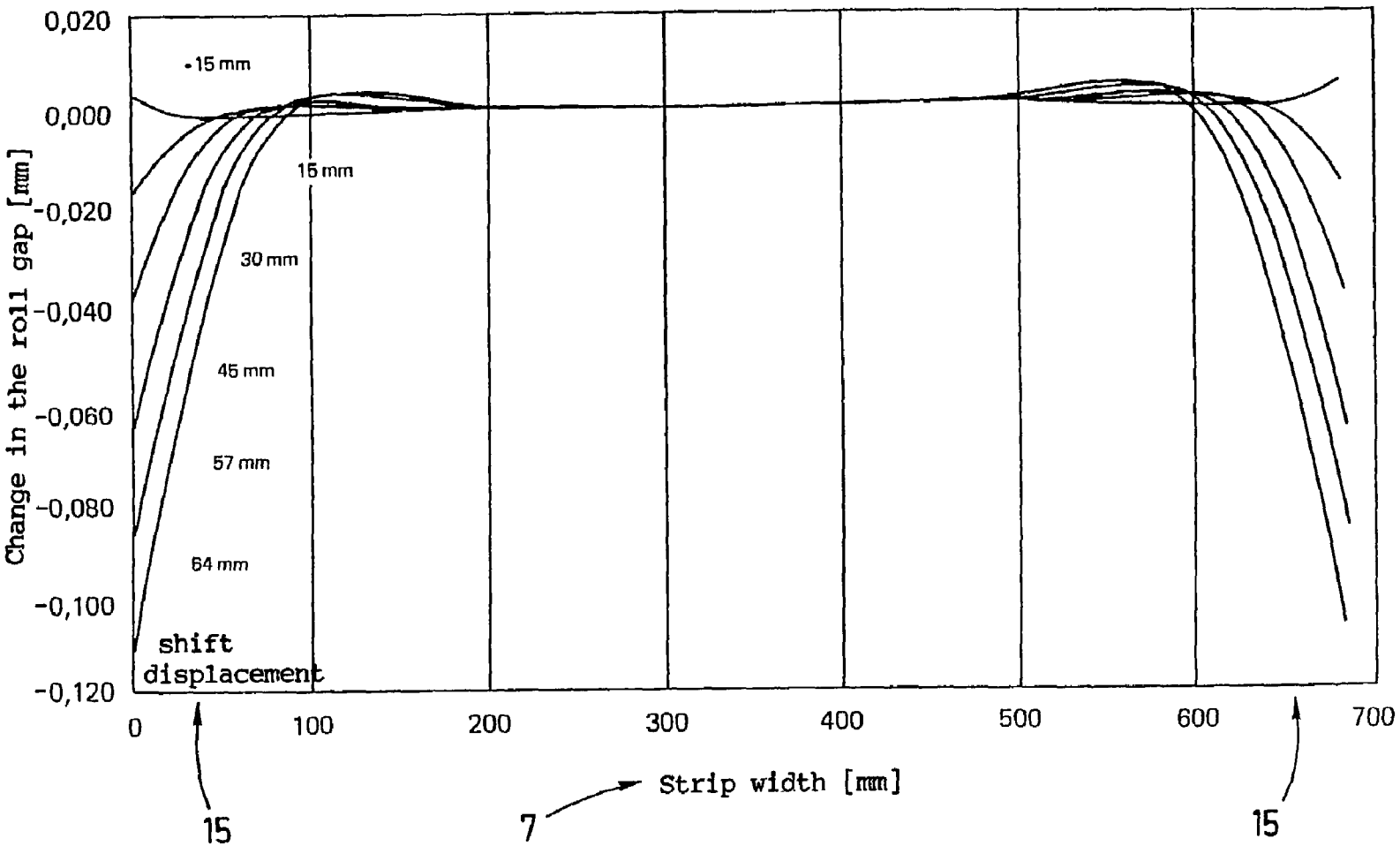
FIG. 4 shows a diagram of the change in the roll gap over the strip width for the influence of the tapered intermediate roll shift.

Corresponding influencing functions, which describe the influence of the tapered intermediate roll shift position on the roll gap profile, are likewise shown over the strip width 7 to the strip edges 15 in FIG. 4.

The decomposition of the flatness error vector into orthogonal polynomials of the tension $\sigma(x)$ leads with suitable analysis to C1 (first order), C2 (second order), C3 (third order), and C4 (fourth order) in $N/mm^2$.

Figure 5A:
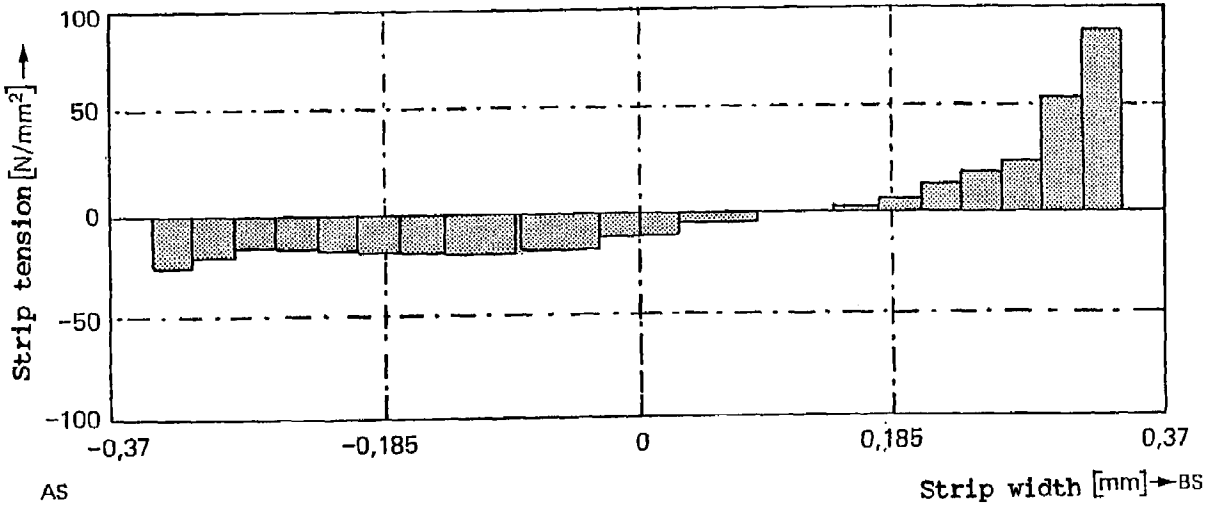
FIG. 5A shows a diagram for the flatness residual error (strip tension over strip width).
Figure 5B:
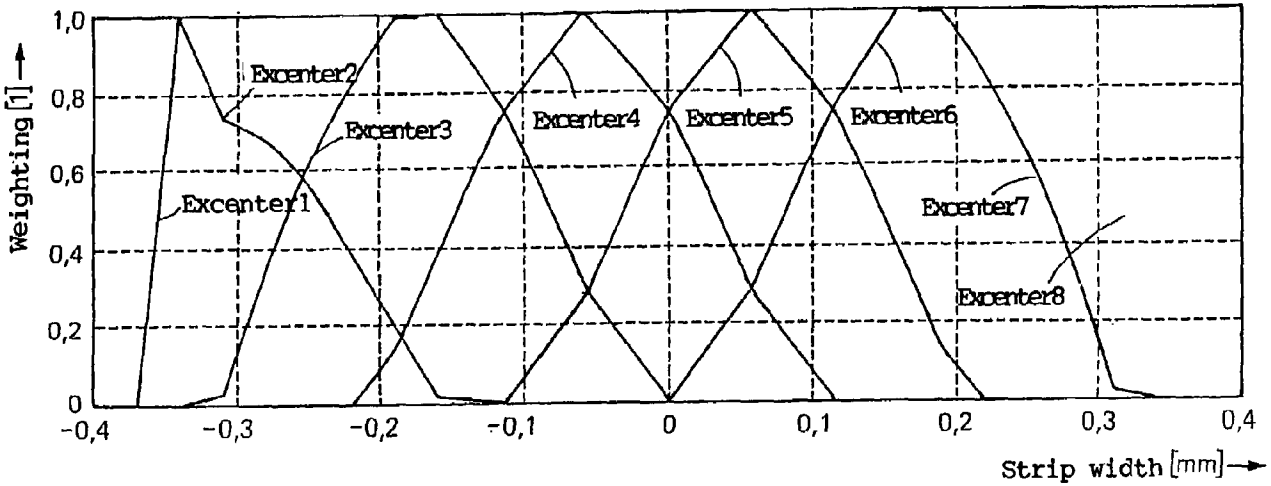
FIG. 5B shows a diagram of the assignment of the flatness residual error to the individual excenters.
Figure 7:
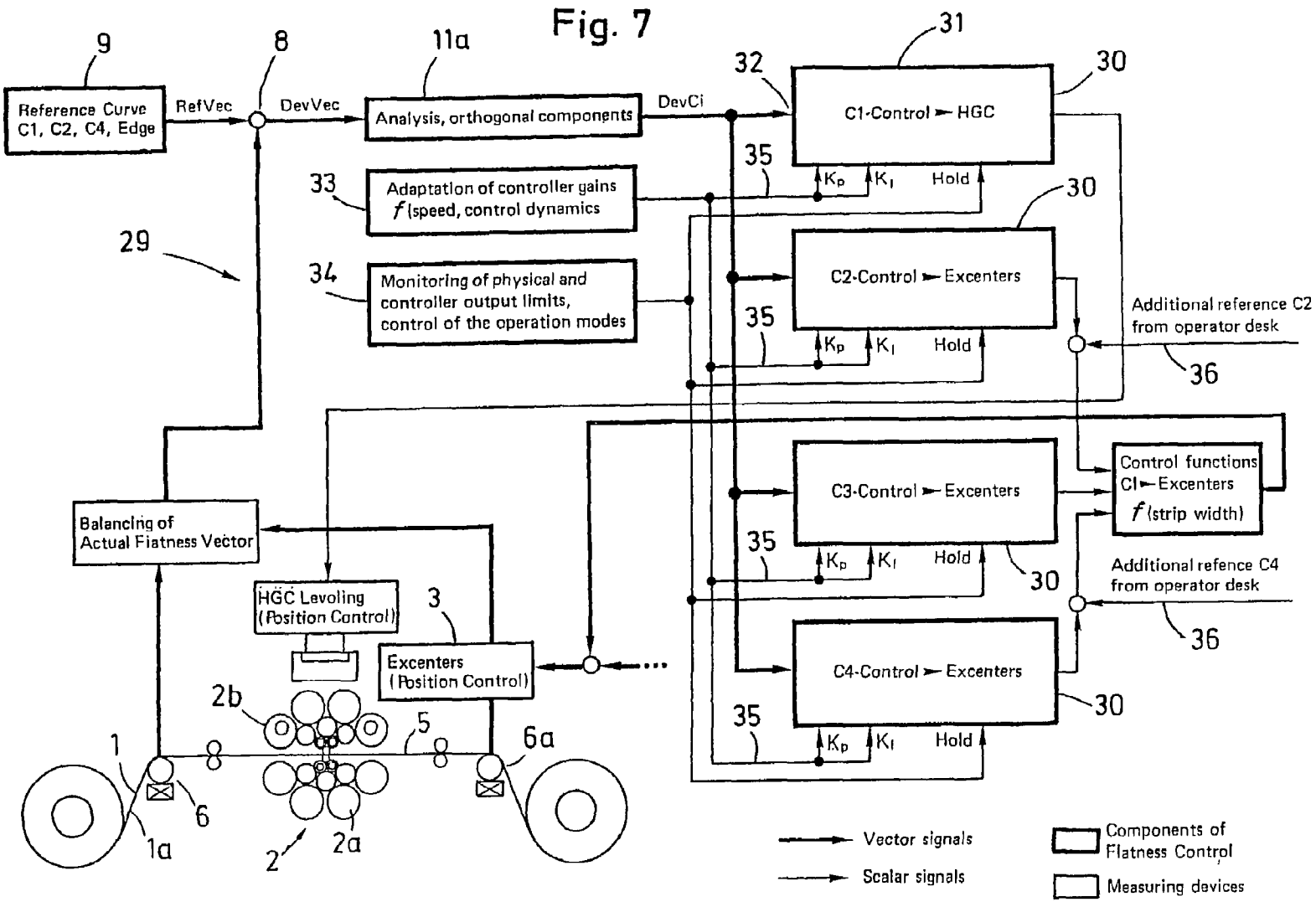
FIG. 7 shows a structural block diagram for Cx control.

FIG. 5A shows an assignment of residual errors to the individual excenters as flatness residual errors 26 (remaining after adjustment action by the Cx control) with the strip tension ($N/mm^2$) over the strip width 7 between the strip edges 15, and FIG. 5B shows the weighting functions for evaluating the flatness residual error 26 for the individual excenters 14*a* as a function of the strip width 7 between the strip edges 15.

The method is apparent from FIG. 6: The actual strip flatness is measured in the runout 5*b* of the cluster mill 2 by the flatness measuring roller 6*a* on the basis of the strip tension distribution (discrete strip tension measured values over the strip width 7) and stored in a tension vector 8. Subtraction of the reference curve 9 (desired curve), which is to be preassigned by the operator, yields, after computation, the tension vector 8 of the flatness error 10 (deviation). The curve of the flatness error 10 over the strip width 7 is approximated in an analytical module 11 by an eighth-order Gaussian approximation (LSQ method) and then decomposed into the orthogonal components C1 . . . Cx. The orthogonal components are linearly independent of one another, which rules out mutual effects of the components among one another. The scalar flatness error components C1, C2, C3, C4 and possibly others are supplied to a first and second control module 12*a* and 12*b* via a first analyzer 11*a*. Similarly, the second and third analyzers 11*b* and 11*c* are connected with the control modules 12*c* and a fourth control module 12*d*.

In detail, the sequence is as follows: A comparison signal 20 between the reference curve 9 and the actual strip flatness 22 of the flatness measuring element 6 at the input 23 of the closed-loop control system 4 is put through to a first analyzer 11*a* and an independent, first control module 12*a* for the formation of the tension vectors 8 (C1 . . . Cx) and with the output 24 to the respective actuator 3 for the hydraulic adjustment mechanism 17 of the set of rolls 2*b*. Output signals of the first analyzer 11*a* also reach the second control module 12*b*. The computational result (f), from control functions 21, is passed on to the actuator 3 of the excenter 14*a* via a coupling connection 25. The comparison signal 20 between the reference curve 9 and the actual strip flatness 22 is put through via the independent analyzer 11*b* to the independent, third control module 12*c* for the flatness residual error 26, whose output 27 is supplied to the coupling connection 25 for the actuator 3 from the excenters 14*a*.

In addition, FIG. 6 shows that the comparison signal 20 between the reference curve 9 and the actual strip flatness 22 is put through via another, third independent analyzer 11*c* to an independent, fourth control module 12*d* for monitoring an edge tension control system 16, and its output 28 is connected to the actuator 3 of the tapered inner intermediate rolls 19. In the runout 5*b* a flatness measuring roller 6*a* is connected to the signal line of the actual strip flatness.

In this regard, it is practical to consider not only the aforementioned components of the flatness error 10, but also a residual error, which is not assigned to the aforementioned orthogonal components but rather directly to the excenters 14*a*. According to FIG. 5B, this assignment is made with weighting functions, which are derived from the excenter influencing functions and assign the total flatness error vector that is present to the individual excenters 14*a*. A scalar magnitude of error is then formed by summation from the residual error vectors 13 assigned to the excenters 14*a*, and this scalar magnitude of error is assigned to the excenters 14*a* by one control module 12*d* each.

For each orthogonal component of the flatness error vector (FIG. 7), the highly dynamic closed-loop control system 29 is provided with a dynamic individual controller 30, which is provided as a PI controller 31 with dead band in the input 32. In addition to the first analyzer 11*a*, adaptive parameterizing means 33 and a control display 34 are arranged in parallel on the input side of each individual controller 30. Connections 35 for control parameters $K_i$ and $K_p$ are provided on each individual controller 30. It is possible for the dynamic individual controllers 30 to be connected with a control console 36.

The individual controller 30 for the C1 component (oblique position) acts on the swiveling set value of the hydraulic adjustment mechanism 17 in the case of the split-block design and on the adjustment of the excenters as the correcting variable in the case of the monoblock design. The individual controllers 30 for all of the other components (C2, C3, C4, and possibly higher orders) act on the excenter actuators 14 of the outer backup rolls 18. The control functions 21 are used for the assignment of the scalar correcting variables supplied by each dynamic individual controller 30 to the excenters 14*a*. The control functions 21 convert a C1, C2, C3 . . . corrective motion to a suitable combination of the individual excenter corrective motions. The aforementioned decoupling guarantees that a corrective motion, e.g., of the C2 controller 30 influences no orthogonal component other than the C2 component. The corresponding control functions are computed in advance from the influencing functions as a function of the strip width 7 and the number of active excenters 14*a*. The PI controllers that are used have, depending on the actuator dynamics and the rolling speed, the adaptive parameterizing means 33, thereby guaranteeing the achievement of the theoretically possible, optimum control dynamics for all operating ranges. Furthermore, the selected approach of the computation of the control parameters $K_i$ and $K_p$ by the method of the absolute optimum allows a very simple startup, since the control dynamics are adjusted from the outside by only one parameter. Correction times of less than 1 second are achieved with the highly dynamic individual controllers 30, depending on the rolling speed.

According to FIG. 8, error components are considered for which no individual controller 30 is provided or for which the associated individual controller 30 is shut off, as are error components that are caused by unavoidable inaccuracies in the computed control functions, e.g., lack of decoupling. Naturally, error components of this type that arise cannot be removed by the highly dynamic individual controllers 30 of the orthogonal components. In order nevertheless to eliminate these error components, the flatness adjustment method contains a residual error removal (FIG. 8). The residual error removal acts on the excenters 14*a* as actuators and with the error analysis described above offers the possibility of eliminating basically all flatness errors in which this is possible on the basis of the given actuator characteristic. Due to the continued coupling between the individual excenters 14*a* and due to possible interactions with the highly dynamic control of the orthogonal components, the residual error control system should be operated only with comparatively low dynamics. The latter are oriented on a constant adjustment speed of the excenters 14*a*, which adjustment speed is capable of parameterization, so that the control system reaches somewhat longer correction times, depending on rolling speed and control deviation. Accordingly, to eliminate residual errors, the residual error vectors 13 are each controlled with the actuators 3 of the excenters 14*a* via residual error controllers 37, 38, and 39.

In order to take into consideration the special concerns related to 20-roll stands and to thin strip rolling and foil rolling with respect to the tension on the strip edges 15 (any strip breakage that may occur, strip flow), the strip edges 15 are treated separately within the flatness control system. Horizontal shifting of the tapered inner intermediate rolls 19 is used as the adjusting mechanism 3. According to FIG. 9, the edge tension control system 16 adjusts a desired strip tension in the region of the one or two outermost covered zones of the flatness measuring roller 6*a* separately for each strip edge 15. As is apparent from FIG. 9, the controlled variable is formed separately for each strip edge 15 by taking the difference between the deviations of the two outermost measured values of the flatness measuring roller 6*a*. In this way, the edge tension control system 16 becomes independent of the reference curve 9 and is decoupled from the other components of the flatness control system. An analyzer 40 for the different strip edge zones of the flatness measuring roller 6*a* is provided for the edge tension control system 16, and each analyzer 40 is connected to two strip edge controllers 41 and 42. The strip edge controllers 41, 42 are connected with the actuators 3 of the tapered intermediate rolls 19. The strip edge controllers 41, 42 can be switched independently of each other. In addition, an adaptive adjustment speed controller 43 and a control display 44 are connected to each set of two strip edge controllers 41, 42. Accordingly, the edge tension control system 16 can be operated optionally asynchronously (independent operation for both strip edges 15) or synchronously. The dynamics of the edge tension control system 16 are shaped by the permissible shift speed of the tapered intermediate roll horizontal shifting, which depends on rolling force and rolling speed.

LIST OF REFERENCE NUMBERS

1 high-grade steel strip
1*a* high-grade steel foil
2 cluster mill
2*a* Sendzimir rolling mill
2*b* set of rolls
3 actuator
4 closed-loop control system
5*a* run-in
5*b* runout
6 flatness measuring element
6*a* flatness measuring roller
7 strip width
8 tension vector
9 reference curve
10 flatness error
11 analytical module
11*a* first analyzer
11*b* second analyzer
11*c* third analyzer
12*a* first control module
12*b* second control module
12*c* third control module
12*d* fourth control module
13 residual error vector
14 excenter actuator
14*a* excenter
15 strip edge
16 edge tension control system
17 hydraulic adjustment mechanism
18 outer backup rolls
19 tapered intermediate rolls
20 comparison signal
21 control functions
22 actual strip flatness
23 input of the closed-loop control system
24 output of the closed-loop control system
25 coupling connection
26 flatness residual error
27 output of the third control module
28 output of the fourth control module
29 highly dynamic closed-loop control system
30 dynamic individual controller for the orthogonal component
31 PI controller with dead band
32 input
33 adaptive parameterizing means
34 control display
35 connection
36 control console
37 residual error controller
38 residual error controller
39 residual error controller
40 analyzer for different strip edge zones
41 strip edge controller
42 strip edge controller
43 adaptive adjustment speed controller
44 control display

The invention claimed is:

1. A method for measuring and adjusting the flatness of a steel strip (1), especially a steel foil (1*a*), for the cold rolling operation in a cluster mill (2), especially in a 20-roll Sendzimir rolling mill (2*a*), which comprises the following steps:

determination of an actual distribution of the flatness (22) of the steel strip over its width (7) on the basis of a measured strip tension distributed over the strip width (7);

determination of a flatness error (8, 20) by comparison of a determined actual distribution of the flatness (22) with a predetermined reference curve;

mathematical approximation of the received flatness error (8, 20);

decomposition of an approximated flatness error into scalar flatness error components (C1, C2, C3, C4); and computation of a first and additional controller output signals from the flatness error components to activate a plurality of actuators (3, 14*a*, 17, 18, 19) of the cluster mill (2); wherein the approximated flatness errors are decomposed in such a way that the resulting flatness error components (C1, C2, C3, C4) are orthogonal to one another;

a first actuator in the form of a hydraulic adjustment mechanism (17) out of the plurality of actuators is activated in response to the first controller output signal, which is obtained from the first orthogonal component (C1);

each of the additional controller output signals in the form of scalar correcting variable components is computed on the basis of one of the remaining orthogonal components (C2, C3, C4) of the flatness error; and the scalar correcting variable components are combined into suitable activating signals for individual excenter actuators (14*a*) out of the plurality of actuators, wherein a residual error vector (13) is analyzed, and the residual error vector (13) is sent to directly selected actuators (3).

2. A method in accordance with claim 1, wherein the curve of the flatness error (10) over the strip width (7) is approximated by an eighth-order Gaussian approximation (LSQ method) and then decomposed into the orthogonal components (C1 . . . Cx).

3. A method in accordance with claim 1, wherein the residual error vectors (13) are assigned by weighting functions, which are derived from influencing functions of excenter actuators (14) and assign the total flatness error (10) that is present to the individual excenters (14*a*).

4. A method in accordance with claim 1 wherein a magnitude of error determined by real numerical values is formed by summation from the residual error vectors (13) assigned to the excenters (14*a*).

5. A method in accordance with claim 1 wherein an adjustment for the strip edges (15) is carried out separately within the flatness adjustment.

6. A method in accordance with claim 5, wherein a horizontal shift of inner intermediate rolls (19) is used as the actuator (3) for an edge tension control system (16).

7. A method in accordance with claim 5 wherein an edge tension control system (16) is operated optionally asynchronously or synchronously for the two strip edges (15).

8. A method in accordance with claim 6, wherein the controlled variable for an edge tension control system (16) is determined separately for each strip edge (7) by taking a difference between the deviations of the two outermost measured values of the flatness measuring roller (6*a*).

9. A device for measuring and adjusting the flatness of a steel strip (1), especially a steel foil (1*a*), for the cold rolling operation in a cluster mill (2), especially in a 20-roll Sendzimir rolling mill (2*a*), with a flatness measuring element (6) in a runout of the cluster mill (2) for determining an actual distribution of the flatness (22) of the steel strip over its width (7) on the basis of a measured strip tension distributed over the strip width (7);

a device for determining a flatness error (8, 20) by comparison of a determined actual distribution of the flatness (22) with a predetermined reference curve; and at least one closed-loop control system (4), which comprises an analytical unit (11) with a first analyzer (11*a*) for the mathematical approximation of a received flatness error (8, 20) and for the decomposition of an approximated flatness error into scalar flatness error components (C1, C2, C3, C4) and which additionally comprises a first and additional control modules (30) connected to an output end of the analytical unit and assigned to the flatness error components for activation of a plurality of actuators (3, 14*a*, 17, 18, 19) of the cluster mill (2); wherein the first analyzer (11*a*) is designed to decompose the flatness errors that are received and approximated by it in such a way that the flatness error components (C1, C2, C3, C4) are orthogonal to one another;

the first control module (30) is provided for activation of one actuator out of the plurality of actuators in the form of a hydraulic adjustment mechanism (17) on the basis of the received first orthogonal component (C1) of the flatness error; the additional control modules for the other orthogonal components (C2, C3, C4) of the flatness error are each designed to produce scalar correcting variable components; and a control unit (21) is provided for combining the scalar correcting variable components received by the individual additional control modules into suitable corrective motions for individual excenter actuators (14*a*) out of the plurality of actuators, wherein a residual error vector (13) is analyzed, and the residual error vector (13) is sent to directly selected actuators (3).

10. A device for measuring and adjusting the flatness of a high-grade steel strip (1) or a high-grade steel foil (1*a*) for a cold rolling operation in a cluster mill (2), especially in a 20-roll Sendzimir rolling mill (2*a*), with at least one closed-loop control system (4) comprising several actuators (3), which consist of hydraulic adjustment mechanisms (17), excenters (14*a*) of the outer backup rolls (18), axially shiftable inner intermediate rolls (19) and/or their influencing functions, wherein a comparison signal (20) between a reference curve (9) and an actual strip flatness (22) of the flatness measuring element (6) at an input (23) of the closed-loop control system (4) is put through to a first analyzer (11*a*) and independent, first and second control modules (12*a*, 12*b*) for the formation of the tension vectors (8/C1 . . . Cx) and with an output (24) to the actuator (3) for swiveling hydraulic adjustment mechanisms (17) of the set of rolls (2*b*), and where the comparison signal (20) is simultaneously put through to a second analyzer (11*b*) and another, separate, third control module (12*c*), whose computational result (f) can be passed on to the actuator (3) of the excenters (14*a*) with a coupling connection, wherein for each flatness error (10), a dynamic individual controller (30) is provided, which is provided as a PI controller (31) with dead band in the input (32).

11. A device in accordance with claim 10, wherein the comparison signal (20) between the reference curve (9) and the actual strip flatness (22) is put through by the independent analyzer (11*b*) to the independent, third control module (12*c*) for a flatness residual error (26), whose output (27) is supplied to the coupling connection (25) for the actuator (3) consisting of the excenters (14*a*).

12. A device in accordance with claim 10 wherein the comparison signal (20) between the reference curve (9) and the actual strip flatness (22) is put through by another, third independent analyzer (11*c*) to an independent, fourth control module (12*d*) for monitoring an edge tension control system (16), and its output (28) is connected to the actuator (3) of the tapered inner intermediate rolls (19).

13. A device in accordance with claim 10 wherein a flatness measuring element (6) installed in the runout (5*b*) is connected to a signal line of the actual strip flatness (22).

14. A device in accordance with claim 10, wherein in addition to the first analyzer (11*a*), adaptive parameterizing means (33) and a control display (34) are arranged in parallel on the input side of each individual controller (30).

15. A device in accordance with claim 10 wherein connections (35) for control parameters ($K_i$, $K_p$) are provided on each individual controller (30).

16. A device in accordance with claim 10 wherein the dynamic individual controllers (30) can be connected with a control console (36).

17. A device in accordance with claim 10 wherein to remove residual errors, a residual error vector (13) cooperates via residual error controllers (37, 38, 39) with the actuators (3) of the excenters (14*a*).

18. A device in accordance with claim 17, wherein the edge tension control system (16) provides an analyzer (40) for different strip edge zones of the flatness measuring roller (6*a*), and that two strip edge controllers (41, 42) are connected to each analyzer (40).

19. A device in accordance with claim 18, wherein the strip edge controllers (41, 42) are connected with the actuators (3) of the tapered intermediate rolls (19).

20. A device in accordance with claim 18 wherein the strip edge controllers (41, 42) can be switched independently of each other.

21. A device in accordance with claim 18 wherein an adaptive adjustment speed controller (43) and a control display (44) are connected to each set of two strip edge controllers (41, 42).

* * * * *